US007972123B2

(12) United States Patent
Koide et al.

(10) Patent No.: US 7,972,123 B2
(45) Date of Patent: Jul. 5, 2011

(54) ELECTRIC COMPRESSOR

(75) Inventors: Tatsuya Koide, Aichi (JP); Kazuya Kimura, Aichi (JP); Ken Suitou, Aichi (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 995 days.

(21) Appl. No.: 11/729,766

(22) Filed: Mar. 28, 2007

(65) Prior Publication Data

US 2007/0231165 A1 Oct. 4, 2007

(30) Foreign Application Priority Data

Mar. 29, 2006 (JP) ..... 2006-091598

(51) Int. Cl.
*F04B 17/00* (2006.01)

(52) U.S. Cl. ..... 417/411; 417/423.14

(58) Field of Classification Search ..... 417/411, 417/423.14; 361/752, 753, 763–766, 820–825; 439/76.2; 310/52, 54, 64, 68 R, 71, 89, 68 D
See application file for complete search history.

(56) References Cited

U.S. PATENT DOCUMENTS

| | | | | |
|---|---|---|---|---|
| 4,621,298 | A * | 11/1986 | McMillen | 361/38 |
| 5,091,823 | A | 2/1992 | Kanbara et al. | |
| 5,548,473 | A * | 8/1996 | Wang | 361/301.1 |
| 6,552,893 | B2 * | 4/2003 | Tanaka et al. | 361/301.3 |
| 6,599,104 | B2 * | 7/2003 | Saito et al. | 417/366 |
| 6,875,029 | B2 * | 4/2005 | Kawabata et al. | 439/76.2 |
| 6,989,616 | B2 | 1/2006 | Okubo et al. | |
| 2004/0052660 | A1 | 3/2004 | Kimura et al. | |
| 2005/0063836 | A1 * | 3/2005 | Kimura et al. | 417/313 |
| 2006/0171127 | A1 * | 8/2006 | Kadoya et al. | 361/752 |

FOREIGN PATENT DOCUMENTS

| | | |
|---|---|---|
| JP | 6-80298 | 11/1994 |
| JP | 2002-369550 | 12/2002 |
| JP | 2004-186640 A | 7/2004 |
| JP | 2004-190547 | 7/2004 |
| JP | 2004-251161 A | 9/2004 |

OTHER PUBLICATIONS

Communication for corresponding Japanese Application No. 2006-091598, dated Mar. 1, 2010.

* cited by examiner

*Primary Examiner* — William H Rodríguez
*Assistant Examiner* — Dnyanesh Kasture
(74) *Attorney, Agent, or Firm* — Locke Lord Bissell & Liddell LLP

(57) ABSTRACT

An inverter assembly includes a substrate, a capacitor assembly and a coil, a varistor and a base. The base fixes and supports thereto the substrate, the capacitor assembly, the coil, and the varistor, and is detachably fixed together to a first housing with screws.

16 Claims, 8 Drawing Sheets

ELECTRIC COMPRESSOR

BACKGROUND OF THE INVENTION

1. Field of the Invention

The present invention relates to an electric compressor, and more particularly to a mounting structure of an inverter for driving an electric motor.

2. Description of the Related Art

As an electric compressor having a compressor mechanism portion, there is known a type having a structure in which an electric motor for driving the compressor mechanism portion and an inverter for controlling and driving the electric motor are further provided.

In such an inverter-type electric compressor, in order to fix the inverter or the structural member thereof to the electric compressor, an inverter chamber is filled with gel and sealed. JP 2003-222078 A discloses an example of an electric compressor of this type.

However, conventional electric compressors have problems in that the inverter is hard or impossible to dismount from the electric compressor, because the inverter is fixed to the housing etc. of the electric compressor by the filled gel.

Therefore, in a conventional electric compressor, maintenance such as replacing the inverter is difficult or cannot be done. In addition, even cases where only the inverter fails, the entire electric compressor must be replaced because the inverter alone cannot be replaced.

SUMMARY OF THE INVENTION

The present invention has been made to solve the above-mentioned problems, and therefore it is an object of the invention to provide an electric compressor in which an inverter assembly can be easily dismounted therefrom.

To solve the above-mentioned problems, an electric compressor according to the present invention includes: a compressor mechanism portion; an electric motor for driving the compressor mechanism portion; a housing for accommodating the compressor mechanism portion and the electric motor; an inverter assembly for converting a direct current into a multi-phase alternate current to supply the converted current to the electric motor and for controlling the rotational frequency of the electric motor; and an inverter accommodation chamber, which is provided by recessing a part of the housing, to accommodate the inverter assembly, characterized in that the inverter assembly includes: a substrate having an electric circuit including a switching element; a component including at least one of a capacitor and a coil; and a base for supporting the substrate and the component, the inverter assembly being detachably fixed inside the inverter accommodation chamber of the housing.

The inverter assembly includes a structure for supporting the component and the substrate by the base. In addition, the inverter assembly is detachably fixed to the housing so that the dismounting of the inverter assemble is facilitated.

According to the present invention, the housing and the inverter assembly of the electric compressor are detachably fixed, so the inverter assembly can be easily dismounted from the electric compressor.

DESCRIPTION OF THE PREFERRED EMBODIMENTS

Now, description will be made of embodiments of the present invention with reference to the accompanying drawings.

Embodiment 1

Figure 1:
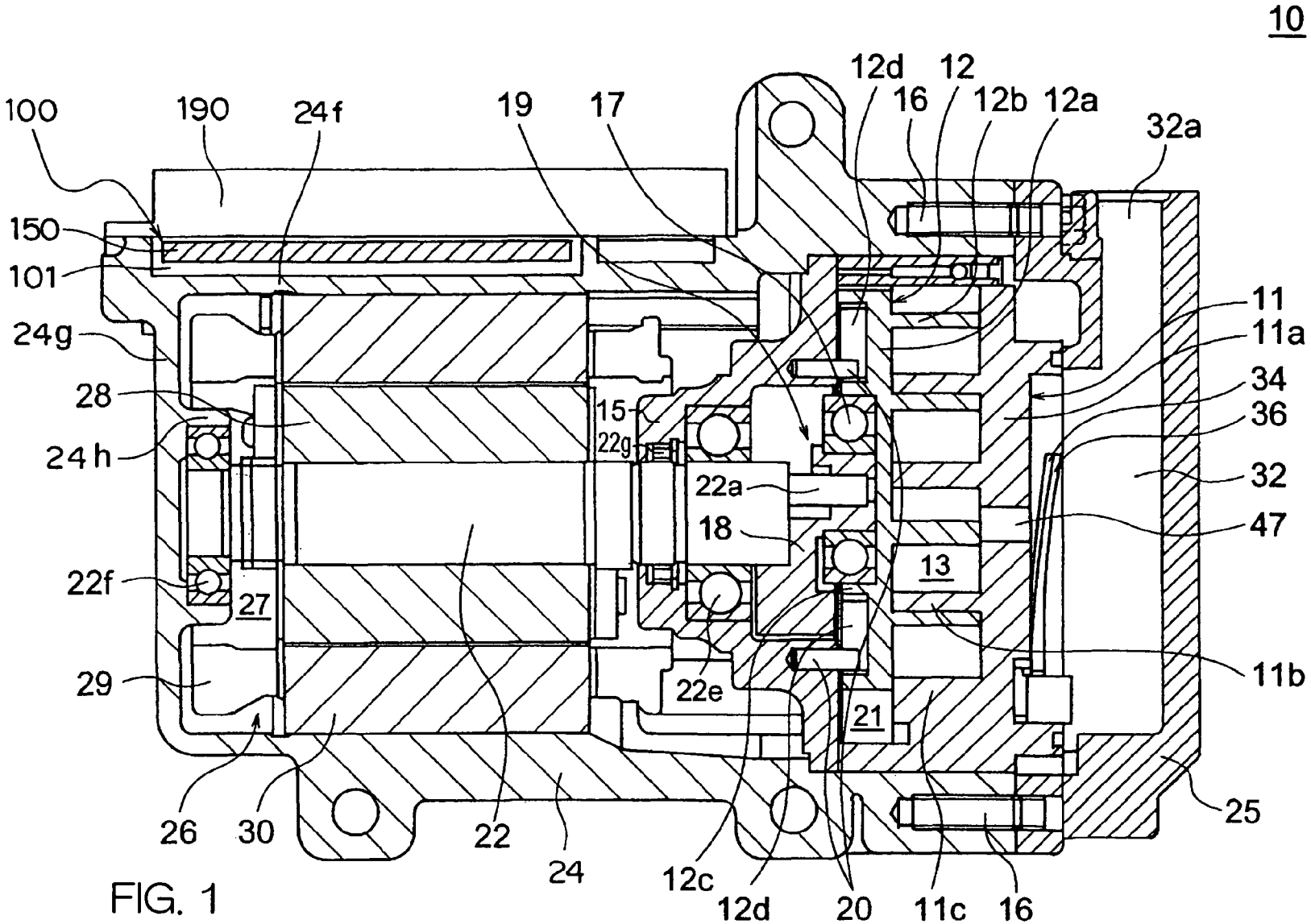
FIG. 1 shows a structure of an electric compressor 10 according to Embodiment 1 of the present invention.

FIG. 1 illustrates an electric compressor 10 according to Embodiment 1 of the present invention.

The electric compressor 10 includes a first housing 24 and a second housing 25. The first housing 24 and the second housing 25 are locked to each other by bolts 16. The first housing 24 has a tubular shape with a closed bottom, including a tubular portion 24*f* and a bottom portion 24*g*, and the bottom portion 24*g* is provided with a shaft supporting portion 24*h* having a cylindrical shape.

Note that, in FIG. 1, the right side of the figure, namely, the second housing 25 side is defined as a front side, and the left side of the figure, namely, the bottom portion 24*g* side of the first housing 24 is defined as a rear side.

The electric compressor 10 includes a fixed scroll 11, a rotary scroll 12 and a compression chamber 13 constructed of the fixed scroll 11 and the rotary scroll 12. The fixed scroll 11 includes a disc-like fixed base 11*a*, a spiral fixed lap 11*b* which is formed upright from the fixed base 11*a*, and a fixed lap outermost wall 11*c*. At the center of the fixed base 11*a*, a discharge port 47 is formed. In the electric compressor 10, the fixed scroll 11, the rotary scroll 12, and the compression chamber 13 constitute a compressor mechanism portion.

The rotary scroll 12 is composed of a disc-like rotary base 12*a* and a rotary lap 12*b* having a spiral shape, which is formed upright from the rotary base 12*a*. At the center on the rear side of the rotary base 12*a*, there is provided a cylindrical holding portion 12*c* having a closed bottom for holding a ball bearing 17.

Further, the electric compressor 10 includes a driving crank mechanism 19 for rotating the rotary scroll 12 (rotational movement) and pins 20 for preventing the rotary scroll 12 from spinning. The pins 20 are fixed to a shaft supporting member 15, and are provided so as to freely engage with an annular concave portion 12*d* of the rotary scroll 12.

The driving crank mechanism 19 is constructed of the holding portion 12*c*, a crank pin 22*a* of a driving shaft 22, and the ball bearing 17 for supporting the crank pin 22*a* via a bush 18.

The driving shaft 22 passes through the center of the electric motor 26. The electric motor 26 is provided to drive the compressor mechanism portion, and is a three-phase synchronous motor composed of the driving shaft 22, a rotor 28, into which the driving shaft 22 is engagingly inserted, and a stator 30, which is provided at an outer periphery of the rotor 28 and is wound by a coil.

The first housing 24 has a recessed part defining an inverter accommodating chamber 101, at an exterior surface and near the rear part of the first housing 24. The inverter accommodating chamber 101 accommodates therein an inverter assembly 100. The inverter assembly 100 is electrically connected to the electric motor 26 via a hermetic terminal (not shown) provided to the first housing 24.

The inverter assembly 100 performs conversion of direct current supplied from outside to multi-phase alternate current, and supplies the converted multi-phase alternate current to the electric motor 26. The inverter assembly 100 also performs control of the rotational frequency of the electric motor 26.

Further, attached to the first housing 24 is a cover 190 for covering the inverter assembly 100 to partition the inverter accommodating chamber 101 from the outside. The cover 190 serves as an outer wall of the electric compressor 10. That is, the cover 190, the first housing 24, and the second housing 25 separate the interior of the electric compressor 10 from the outside. Further, the inverter accommodating chamber 101 is defined as a space between the cover 190 and the first housing 24 inside the electric compressor 10.

Note that, when the electric compressor 10 is operated, the electric compressor 10 is set so that the direction when viewed from the driving shaft 22 to the inverter assembly 100 in FIG. 1 is on top. In other words, the inverter assembly 100 is arranged above the first housing 24.

An end of the driving shaft 22 on the driving crank mechanism 19 side is supported by the shaft supporting member 15 via a ball bearing 22*e*, and the rear end is supported by the shaft supporting portion 24*h* of the first housing 24 via a ball bearing 22*f*. Further, a seal 22*g* is provided on the rear side of the ball bearing 22*e* to seal the gap between the driving shaft 22 and the shaft supporting member 15.

A fluid which is a refrigerant circulates within a space covered by the first housing 24 and the second housing 25. In this space, a portion defined by the first housing 24 and the shaft supporting member 15 is a motor chamber 27, and a portion defined by the first housing 24, the second housing 25, and the shaft supporting member 15 is a crank chamber 21. The motor chamber 27 communicates with the crank chamber 21 through an intake path (not shown).

With respect to the discharge port 47, a discharge chamber 32 defined by the fixed scroll 11 and the second housing 25 is provided on an opposite side of the compression chamber 13. The refrigerant compressed in the compression chamber 13 is discharged to the discharge chamber 32 through the discharge port 47. Provided in the discharge chamber 32 are a reed valve 34 and a retainer 36, which prevent back flow of the refrigerant, namely, generation of the flow of the refrigerant toward the discharge port 47 from the discharge chamber 32. Further, the discharge chamber 32 includes an external opening 32*a* communicating with the outside. Through the external opening 32*a*, the interior and the outside of the electric compressor 10 communicate with each other.

In the electric compressor 10 constructed as described above, the refrigerant flows into the motor chamber 27 through the intake port (not shown) from the outside. Further, the refrigerant flows from the motor chamber 27 into the crank chamber 21 and the compression chamber 13 communicating with the crank chamber through the intake path (not shown). In the compression chamber 13, the refrigerant is compressed by the rotation of the rotary scroll 12 in association with the rotation of the driving shaft 22. The compressed refrigerant flows into the discharge chamber 32 from the discharge port 47, and is further discharged outside through the exterior opening 32*a*.

Figure 2:
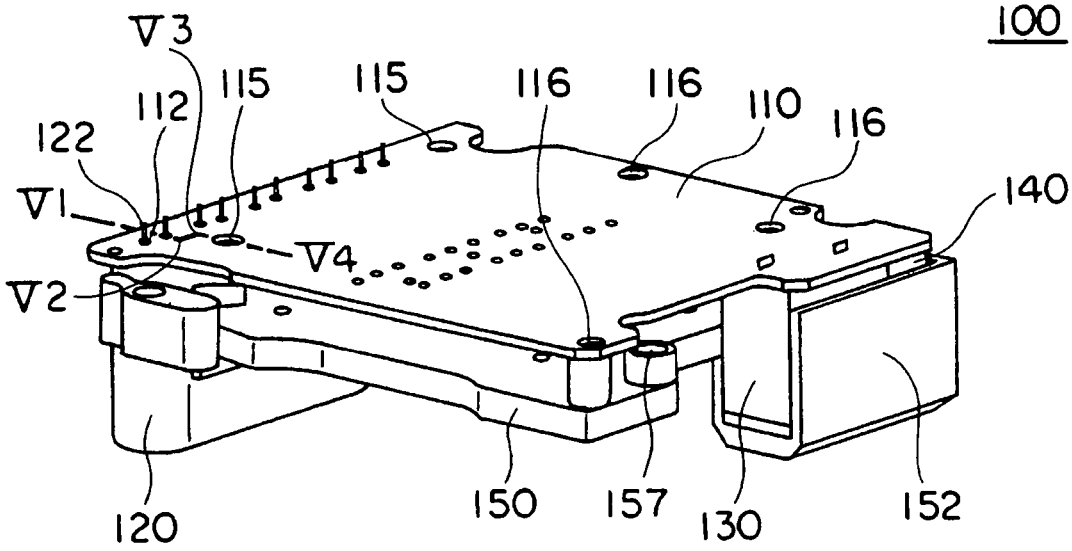
FIG. 2 shows a structure of an inverter assembly 100 incorporated into the electric compressor 10 according to Embodiment 1 of the present invention.
Figure 3:
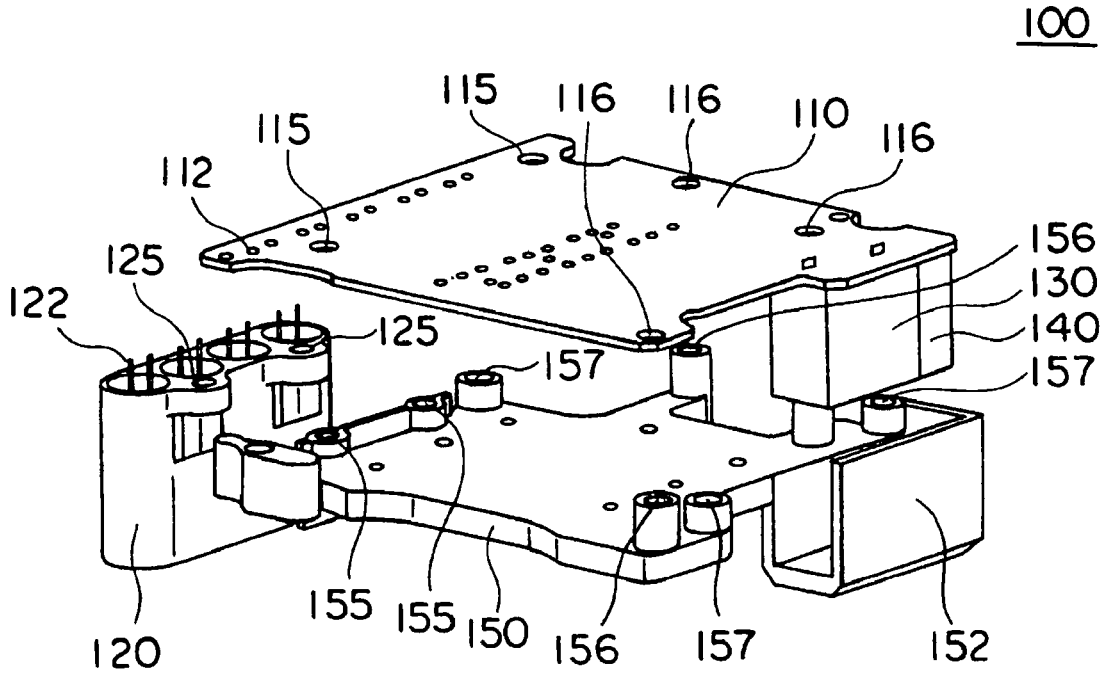
FIG. 3 shows a mounting method for the inverter assembly 100 of FIG. 2.

FIGS. 2 and 3 each show the structure of the inverter assembly 100 according to Embodiment 1 of the present invention.

FIG. 2 illustrates an assembled state of the inverter assembly 100, and FIG. 3 illustrates a method of assembling the inverter assembly 100. Note that, as described later, when assembling the inverter assembly 100, screws are used, but illustration of the screws is omitted in FIGS. 2 and 3 for simplification.

The inverter assembly 100 includes a substrate 110 having an electric circuit including a switching element such as a transistor, and a base 150 for fixing and supporting thereto the substrate 110 and the other members described later. Through the substrate 110 and the base 150, a capacitor assembly 120, a coil 130, and a varistor 140 are fixed and supported thereto.

Figure 4:
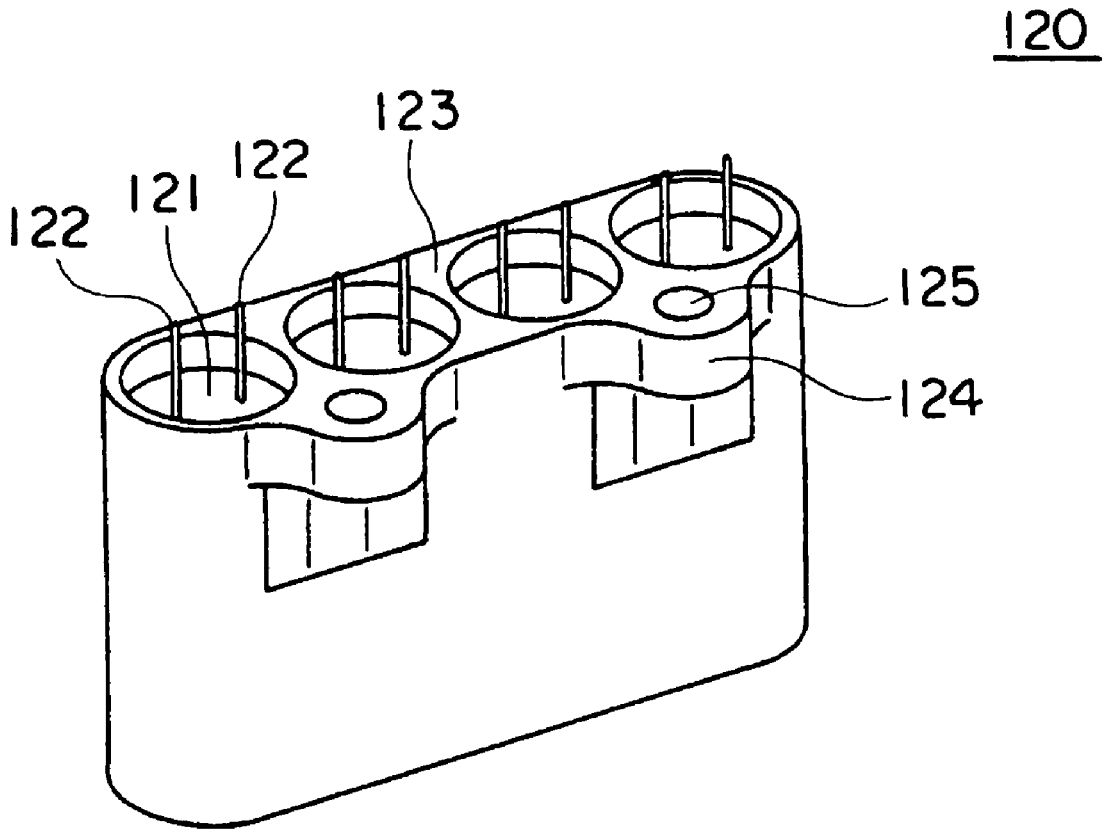
FIG. 4 shows a structure of a condenser assembly 120 according Embodiments 1 and 2 of the present invention.

FIG. 4 illustrates the structure of the capacitor assembly 120. The capacitor assembly 120 has four capacitors 121 arranged in a case 123, which is a resin molded accommodating container. Resin is filled into the gaps of the case 123, and the four capacitors 121 are fixed and integrated into one. The capacitors 121 are electric capacitors, for example, and have two terminals 122, respectively. The capacitors 121 are electrically connected with the electric circuit provided on the substrate 110 via the terminals 122.

Further, the capacitor assembly 120 has mounting portions 124 with which the base 150 supports the capacitor assembly 120. The two mounting portions 124 are integrally formed with the case 123. The mounting portions 124 each have a screw mounting hole 125, which is formed such that the hole passes vertically through the mounting portion 124. The mounting portions 124 project from the case 123 so as to surround the screw mounting holes 125 in a circumferential direction. In addition, the top surface of the mounting portions 124 is flush with the top surface of the case 123.

As illustrated in FIGS. 2 and 3, the substrate 110 has connecting portions 112 mating with the terminals 122 one by one. The substrate 110 and the terminals 122 are solder-jointed at the connecting portion 112, and the substrate 110 and the terminals 122 are electrically connected thereby. Also, in the substrate 110, a plurality of screw mounting holes are formed so as to fix the substrate 110 to the base 150. The plurality of screw mounting holes include two screw mounting holes 115 for fixing the substrate 110, the base 150, and the capacitor assembly 120 together, and three screw mounting holes 116 for fixing the substrate 110 and the base 150 only.

Further, as illustrated in FIG. 3, the coil 130 and the varistor 140 are fixed to the substrate 110 and electrically connected to the substrate 110 in an assembly stage before the substrate 110 is fixed to the base 150.

The capacitor 121, the coil 130, and the varistor 140 are components of the inverter assembly 100, respectively. Also, those components are called large components, because they are relatively large compared with other components of the inverter assembly 100. They are relatively large compared with other components, particularly, in vertical dimensions, namely, in a thickness direction of the substrate.

The base 150 includes a receiving portion 152 integrally formed therewith, for covering a part of the exterior surfaces of the coil 130 and the varistor 140. The coil 130 and the varistor 140 are juxtaposed with each other to form one rectangular parallelepiped shape. The receiving portion 152 covers four faces, which is two faces less than the six faces of a rectangular parallelepiped. One of the two faces not covered by the receiving portion 152, corresponds to the face covered by the substrate 110. The other of the two faces corresponds to the face of the coil 130 which is opposite to the face brought into contact with the varistor 140. Further, among the four faces covered by the receiving portion 152, the three faces which are vertical to the substrate 110, are partly uncovered and exposed from the receiving portion 152, in areas close to the substrate 110.

As illustrated in FIG. 2, the coil 130 and the varistor 140 are bonded and fixed to the receiving portion 152 by a resinous adhesive. In other words, the coil 130 and the varistor 140 are fixed to the receiving portion 152 by potting.

Further, at that time, clearance is formed at a lower side of the receiving portion 152 which covers the coil 130 and the varistor 140, namely, in the direction of gravity of the exterior surface of the receiving portion 152 when the electric compressor 10 is set so that the electric compressor 10 is operable.

Here, the clearance is a space where no solid or liquid exists between the exterior surface of the receiving portion 152 and a structure covering the exterior surface, namely, the first housing 24. A part of the exterior surface below the receiving portion 152 is not brought into contact with the adhesive and the other members, and is exposed to this space. In other words, the exterior surface in the direction of gravity side of the receiving portion 152 is spaced apart from the first housing 24, which is opposed to the exterior surface of the receiving portion 152.

Further, the base 150 is provided with a plurality of screw holes and the screw mounting holes. The screw holes include two screw holes 155 for fixing the substrate 110, the base 150, and the capacitor assembly 120 together, three holes 156 (only two of three are shown) for fixing the substrate 110 and the base 150 only, and three screw mounting holes 157 for fixing the base 150, the cover 190, and the first housing 24 together.

Figure 5:
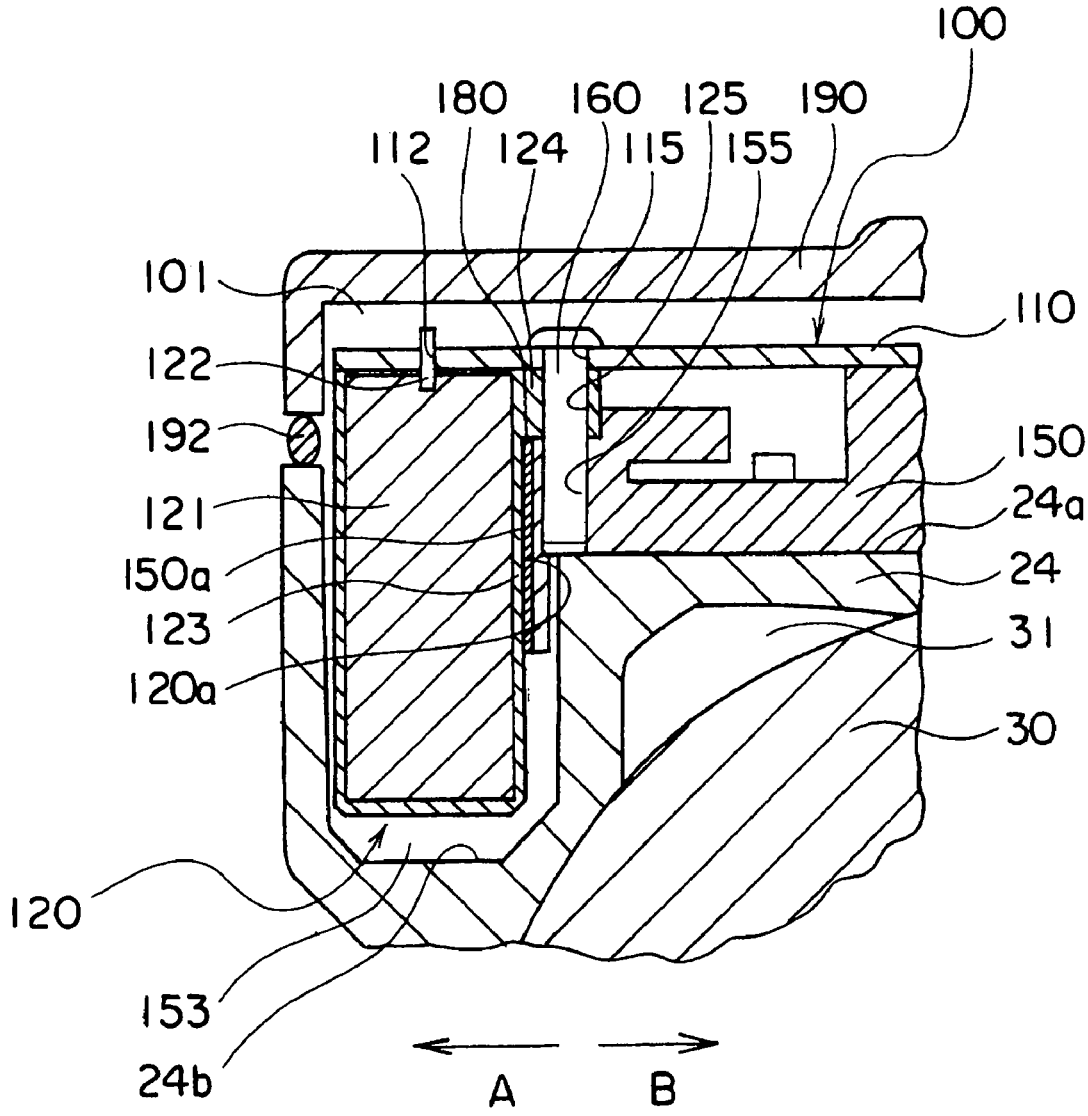
FIG. 5 is a displacement sectional view taken along the line V1-V2-V3-V4 of FIG. 2.

FIG. 5 is a displacement sectional view taken along the line V1-V2-V3-V4 of FIG. 2, and illustrates a mounting structure of the inverter assembly 100 with the surroundings. A straight line, which is included in the cross section and is parallel to the substrate 110, namely, among the directions of the straight lines V1-V2 and V3-V4, directions which are opposite each other are indicated by an arrow A and an arrow B.

FIG. 5 is a sectional view taken along a plane vertical to the driving shaft 22 of FIG. 1. However, the position of the axial direction of the cross section is displaced according to the location. In the area including the capacitor 121 and farther than that in the direction of arrow A, the figure shows a cross section of a position including one of terminals 122 (V1-V2 line of FIG. 2). In the area including the mounting portion 124 and farther than that in the direction of arrow B, the figure shows the cross section of a position including the axes of the screw mounting hole 115, the screw mounting hole 125 and the screw hole 155 (V3-V4 line cross section of FIG. 2).

As illustrated in FIG. 5, between the cover 190 and the first housing 24, an O-ring 192 is sandwiched. With this, the inverter accommodating chamber 101 is isolated from the outside.

The exterior surface of the first housing 24 includes a plane surface portion 24*a* for supporting the base 150. The exterior surface of the first housing 24 also includes a cavity portion 24*b* which is depressed toward below than the plane surface portion 24*a*, receives the capacitor assembly 120, and covers the lower part of the capacitor assembly 120.

Between the first housing 24 and the stator 30, a refrigerant path 31 is defined, and the refrigerant flows therethrough. The refrigerant cools the inverter assembly 100 via the first housing 24, and cools the electric motor 26 via the stator 30.

The capacitor assembly 120 and the capacitor 121 contained therein are arranged away from the driving shaft 22, namely, at the arrow A side end of the base 150. As illustrated in FIG. 5, the distance between the substrate 110 and the plane surface portion 24*a* of the first housing 24 is smaller than the vertical dimension of the capacitor assembly 120 which is a large component. However, the outer circumferential surface of the stator 30 has a cylindrical surface shape, so the outer circumferential surface of the stator 30 departs from the driving shaft 22. In other words, the outer circumferential surface of the stator 30 curves downward as the outer circumferential surface moves in the direction of arrow A. The cavity portion 24*b* of the first housing 24 is formed according to the curvature of the outer circumferential surface, and the space for receiving the capacitor assembly 120 is defined by the cavity part 24*b*.

Note that, as illustrated in FIG. 2, with respect to the base 150, the coil 130 and the varistor 140 are arranged at positions which are opposed to the capacitor assembly 120. The first housing 24 includes the cavity portion (not shown) for accommodating the coil 130 and the varistor 140 as well as the cavity portion 24*b*. The cavity portion (not shown) is provided to the position, which is opposed to the cavity portion 24*b* in the direction of arrow B in FIG. 5.

At a portion where the capacitor assembly 120 is adjacent to the base 150 (excluding a part for forming a projected mounting portion 124), an exterior surface 120*a* of the capacitor assembly 120 and the exterior surface 150*a* of the base 150 are bonded and fixed by a resinous adhesive 180.

In addition, as described above, the substrate 110 and the terminals 122 of the capacitor assembly 120 are soldered at the connecting portion 112. Accordingly, the capacitor assembly 120 and the substrate 110 are also fixed by the connecting portion 112.

Assembly of the inverter assembly 100 is performed using screws 160 as screw members. The screws 160 are each passed through the screw mounting holes 115 and the screw mounting holes 125, and to be screwed together with the screw holes 155. As a result, the substrate 110, capacitor assembly 120, and the base 150 are fixed.

As described above, the capacitor assembly 120 is supported to the substrate 110 via the connecting portion 112, and is supported to the base 150 via the mounting portion 124 and the exterior surface 120*a* as well.

The capacitor assembly 120 does not come in contact with the cover 190 and the first housing 24. A part of the exterior surface of the capacitor assembly 120 comes in contact with the substrate 110, screws 160, and the base 150, but the other parts do not come in contact with any members. At the exterior of the non-contact part of the capacitor assembly 120, there is formed a clearance 153. In this case, the clearance 153 is defined by the space between the exterior of the capacitor assembly 120 and the covering structure for the exterior, namely, the cavity portion 24*b*, where no solid or liquid exists. A part of the exterior surface of the capacitor assembly 120 does not come in contact with the adhesive 180 or the other members, and is exposed to this space. The clearance 153 is formed at least below the capacitor 121, namely, in the direction of gravity side when the electric compressor 10 is set so that the electric compressor 10 is operable.

As described above, the substrate 110, the capacitor assembly 120, the coil 130, and the varistor 140 are supported to the base 150, and the inverter assembly 100 is assembled as illustrated in FIG. 2. The fixing of the inverter assembly 100 to the first housing 24 is effected by the detachable fixing of the base 150 to the first housing 24, where screws (not shown) as screw members are passed through three screw mounting holes 157, and to tighten the screw in the screw hole (not shown) of the first housing 24. In this case, the detachable fixing is realized with screws only. That is, the inverter assembly 100 can be removed from the first housing 24 by removing the screws.

Note that, in the electric compressor 10, gel for fixing the inverter assembly 100 to the first housing 24 is not encapsulated into the inverter accommodating chamber 101.

Method for assembling the inverter assembly 100 constructed as described above, and a method of incorporating the inverter assembly 100 into the electric compressor 10, are described hereinbelow.

First, as illustrated in FIG. 3, the coil 130 and the varistor 140 are mounted to the substrate 110.

Then, the capacitor assembly 120 is mounted to the substrate 110. In this case, the terminals 122 are arranged so as to penetrate the corresponding connecting portions 112, respectively, and soldering is performed at the respective connecting portions 112.

Next, the substrate 110 and the large components, which have been already mounted to the substrate 110, are mounted to the base 150. In this case, as illustrated in FIG. 2, the coil 130 and the varistor 140 are bonded to the receiving portion 152. As illustrated in FIG. 5, the exterior surface 120*a* of the capacitor assembly 120 is bonded to the exterior surface 150*a* of the base 150. In addition, the substrate 110, the capacitor assembly 120, and the base 150 are fastened together by the screws 160.

Lastly, the base 150 and the first housing 24 are detachably fixed by the screws (not shown), which screw-fit to the screw mounting holes 157.

The electric compressor 10 according to Embodiment 1 of the present invention is constructed as described above. Accordingly, the following effects can be obtained.

Gel or the like is not used to fix the first housing 24 and the inverter assembly 100 of the electric compressor 10. Therefore, the degree of freedom at the time of maintenance work such as replacement is enhanced compared with a case where gel or the like is encapsulated thereinto to secure the fixation. For example, during operation of the electric compressor 10, in a case where only the inverter assembly 100 malfunctions and the other members seem to be normal, only the inverter assembly 100 is removed from the first housing 24 to replace it with a new and similar type of inverter assembly. As a result, the repair work on the electric compressor 10 can be performed easily.

In particular, in the case where the electric compressor 10 is mounted to a vehicle for use, the inverter assembly 100 alone can be replaced while leaving the electric compressor 10 mounted on the vehicle and leaving the body of the electric compressor as is. As a result, the electric compressor 10 can be easily repaired.

Further, as screws are used for the detachable fixing, mounting or dismounting of the inverter assembly 100 to the first housing 24 is facilitated at the time of assembly when manufacturing the electric compressor 10 or of disassembly during maintenance or the like.

In addition, the inverter accommodating chamber 101 is not provided on the exterior of the electric compressor 10, but is formed inside the electric compressor 10 by recessing a part of the first housing 24. Therefore, the electric compressor 10 can be designed while taking the profile of the inverter accommodating chamber 101 into account, so downsizing of the entire electric compressor 10 can be made in comparison with a construction in which the inverter accommodating chamber 101 is provided on the exterior.

The capacitor 121, the coil 130, and the varistor 140 being the large components are arranged away from the driving shaft 22 of the electric compressor 10, and are accommodated in the cavity portion 24*b* and the cavity portion (not shown) of the first housing 24. Therefore, there is no need to align the lower ends of the respective members, with the result that the distance between the substrate 110 and the plane surface portion 24*a* of the first housing 24, that is, the interval in the vertical direction can be made smaller than the vertical dimension of the large component. As a result, overall size of the electric compressor 10 can be made smaller.

Further, as the substrate 110 and the large components are supported by the base 150, being a single member, the support structure becomes simple. Thus, downsizing of the whole electric compressor 10 can be made.

The coil 130 and the varistor 140 are fixed to the substrate 110 as well as bonded to the receiving portion 152 of the base 150 and fixed thereto, thereby attaining more secure fixing and enhanced anti-shock characteristics.

In addition, employment of adhesive fixing eliminates the work for filling gel which involves more process steps and cost. As a result, reductions in the number of process steps and cost can be made.

Cases where the generation of water inside the inverter accommodating space because of condensation or infiltration of moisture from the outside due to imperfect sealing of the inverter accommodating space or the like may occur. In conventional electric compressors, the large components are fixed by filling gel in its surroundings. Accordingly, there is no escape for water, so there is a risk of short-circuits.

In the electric compressor 10 according to Embodiment 1 of the present invention, even in the case where water is generated inside the inverter accommodating chamber 101, the moisture gathers, due to gravity, at the clearance 153 formed in the direction of gravity of the capacitor assembly 120, and at the clearance (not shown) in the direction of gravity of the receiving portion 152 covering the coil 130 and the varistor 140. As a result, short-circuits can be avoided.

The plurality of capacitors 121 are integrated into the capacitor assembly 120. Therefore, only a single member of the capacitor assembly 120 needs to be fixed onto the base 150. As a result, the number of working steps can be reduced compared with a structure having each capacitor 121 individually fixed thereonto.

Further, when the plurality of capacitors 121 are integrated into the capacitor assembly 120, the case 123 is used as a receiving container, so connection work for connecting the capacitors 121 with each other can be omitted. As a result, the work for integrating the capacitors 121 is facilitated so that the work efficiency can be improved.

The capacitor assembly 120 has the mounting portions 124 projecting from the case 123. As a result, mounting work is facilitated so that the work efficiency can be improved. Further, when mounting the capacitor assembly 120 onto the base 150, the screws 160 as screw members are used. As a result, mounting work is facilitated so that the work efficiency can be improved.

Embodiment 2

Figure 6:
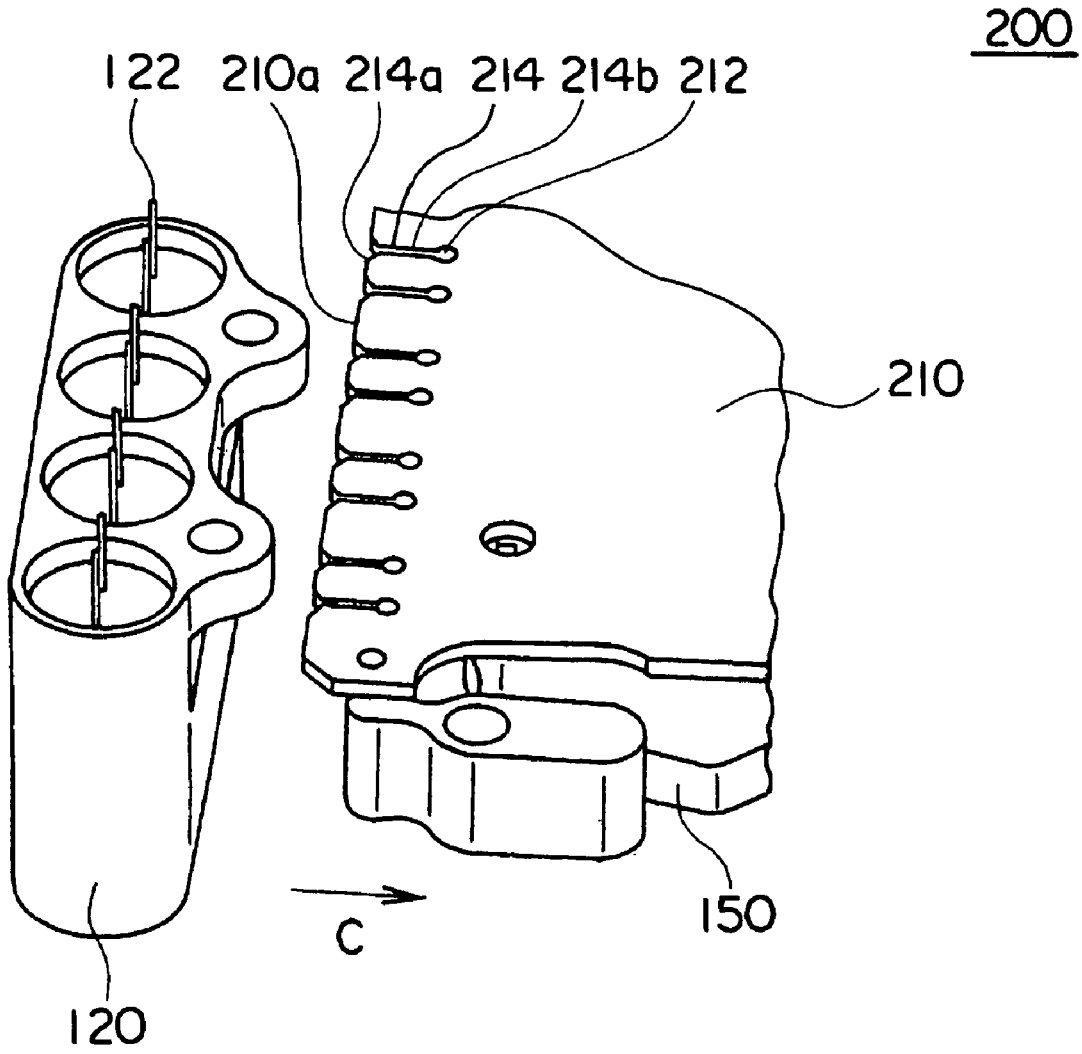
FIG. 6 shows a mounting method for the inverter assembly 200 according to Embodiment 2 of the present invention.

Embodiment 2 has a structure in which the structure of the substrate 110 of Embodiment 1 is modified in the areas surrounding the connecting portion 112 as illustrated in FIG. 6.

Figure 7:
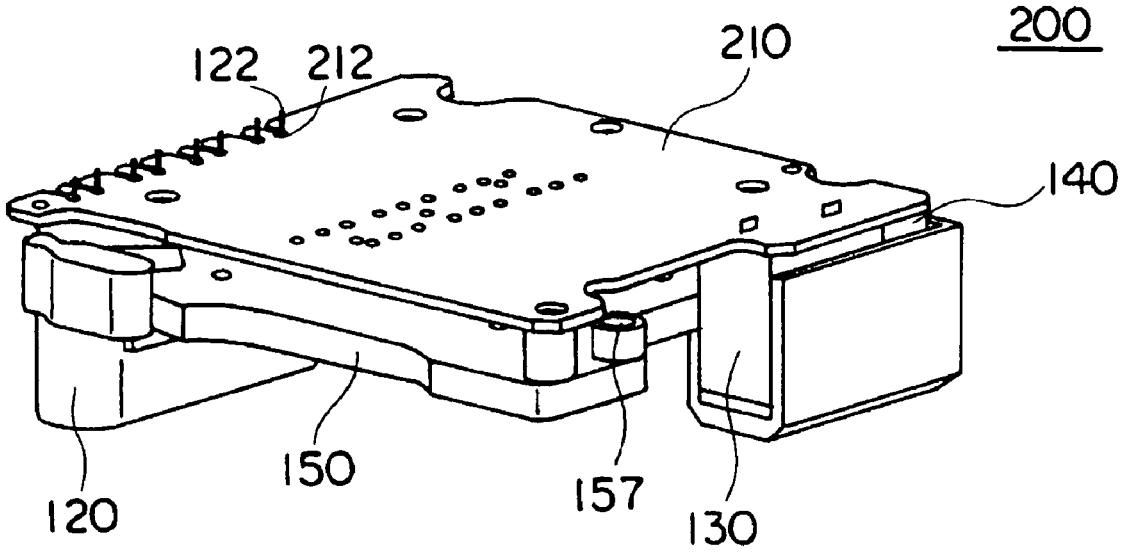
FIG. 7 shows a structure of the inverter assembly 200 of FIG. 6.

FIGS. 6 and 7 illustrate the structure of an inverter assembly 200 used in the electrical compressor according to Embodiment 2 of the present invention. FIG. 6 illustrates a method of assembling the inverter assembly 200, and FIG. 7 illustrates an assembled state of the inverter assembly 200. Screws are used for assembling the inverter assembly 200, but the illustration of the screws is omitted. Note that, in Embodiment 2, the same reference symbols as used in FIGS. 1 to 5 of Embodiment 1 refer to the same or similar constructional elements, so the detailed descriptions thereof are omitted.

Hereinafter, description will be made of the points different from Embodiment 1 of the present invention.

As illustrated in FIG. 6, a substrate 210 includes slits 214 corresponding to respective connecting portions 212 (portions corresponding to the connecting portions 112 illustrated in FIG. 2, etc. of Embodiment 1). The connecting portions 212 mate with the terminals 122 of the capacitor assembly 120 one by one, so the slits 214 similarly mate with the terminals 122 one by one.

The slits 214 each include an inlet portion 214*a* formed on an end 210*a* side of the substrate 210 and a straight line portion 214*b* formed on the connecting portion side 212.

The width of the inlet port 214*a* is wide on the end 210*a* side, and gradually becomes narrower toward the straight line portion 214*b* side. The width of the straight line portion 214*b* is constant from the inlet portion 214*a* side to the connecting portion 212 side. In otherwords, the width of the slit 214 becomes continuously narrower from the end 210*a* toward the connecting portion 212, when viewed in total including the straight line portion 214*b* having a constant width.

Hereinafter, description will be made of an assembly method for the inverter assembly 200 constructed as described above.

First, similarly to Embodiment 1 as illustrated in FIG. 3, the coil 130 and the varistor 140 are mounted onto the substrate 210.

Next, as illustrated in FIG. 6, the substrate 210, and, the coil 130 and the varistor 140 which have already been mounted to the substrate 210, are mounted to the base 150. Unlike Embodiment 1, the mounting of substrate 210 to the base 150 is performed before the mounting of the capacitor assembly 120.

Subsequently, the capacitor assembly 120 is mounted to the substrate 210. At this time, adhesive is applied to a portion out of the base 150 which is brought into contact with the capacitor assembly 120. Then, the respective terminals 122 are aligned with relatively wider inlet portions 214*a* formed on the end 210*a* side of the substrate 210, and thereafter, forced along the slits 214 which continuously become narrower, namely, in the direction of arrow C of FIG. 6, to the connecting portions 212. At this time, the capacitor assembly 120 and the base 150 are brought into contact with each other, and are bonded by the adhesive which has already been applied thereto.

After the capacitor assembly 120 is arranged in this manner, the soldering of the substrate 210 with the terminals 122 at the connecting portions 212, and the tightening of the screws 160 (refer to FIG. 3, not shown in FIGS. 6 and 7).

In this way, the substrate 210, the capacitor assembly 120, the coil 130, the varistor 140, and the base 150 are fixed to each other, and the inverter assembly 200 is assembled.

After that, similarly to the inverter assembly 100 according to Embodiment 1, the screws (not shown) passing through the screw mounting holes 157, the base 150 and the first housing 24 are detachably fixed to each other, and the inverter assembly.200 is mounted to the electric compressor.

In this way, in the inverter assembly according to Embodiment 2, the slits 214 continue from the end 210*a* of the substrate 210 to the connecting portions 212. Accordingly, when mounting the terminals 122 to the connecting portions 212, not only the method involving passing the tips of the terminals through from below the connecting portions 212, but also the method involving forcing the middle portions of the terminals 122 along the slits 214 may be employed. In this way, the degree of freedom in terms of the method of assembly may be enhanced.

Besides, in the inverter assembly 200, the slits 214 become continuously narrower. Accordingly, the precision which is required for the alignment of the terminals 122 may be lowered to facilitate the mounting operation, and the work efficiency can be enhanced.

Embodiment 3

In Embodiment 3, the method of mounting the capacitor assembly 120 and other points in Embodiment 1 are modified.

Figure 8:
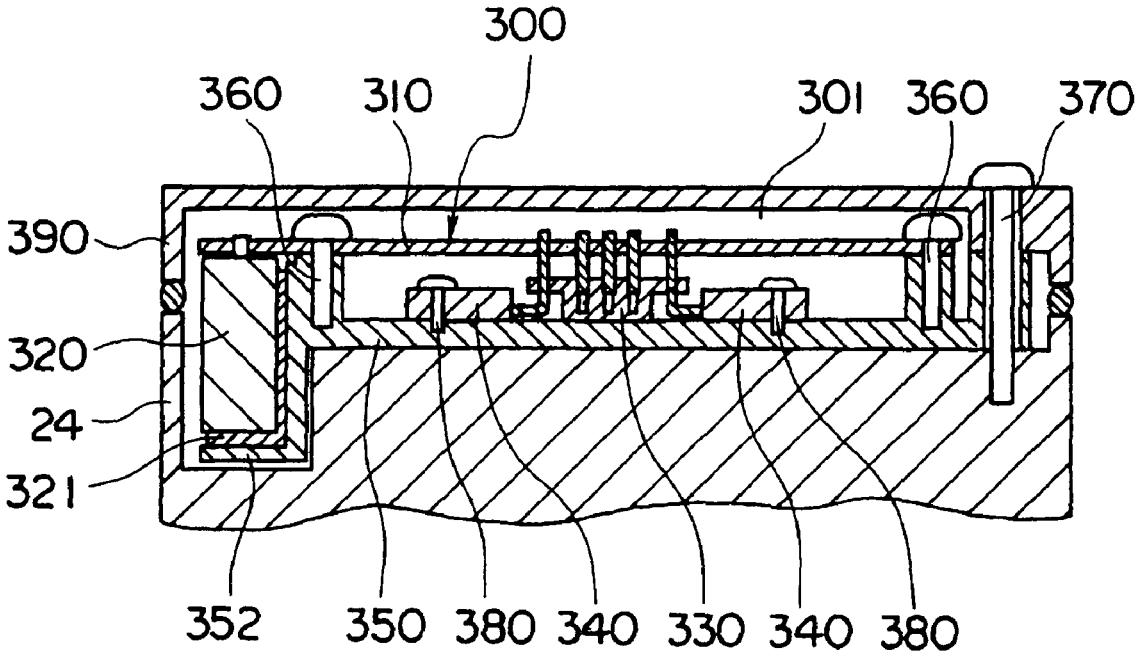
FIG. 8 shows a structure including the inverter assembly 300 according to Embodiment 3 of the present invention.

FIG. 8 illustrates the structure including the inverter assembly 300 used in the electric compressor according to Embodiment 3.Note that, in Embodiment 3, the same reference symbols as used in FIGS. 1 to 5 of Embodiment 1 are for the same or similar constructional elements, so the detailed descriptions thereof are omitted.

Hereinafter, description will be made of the points different from Embodiment 2 of the present invention.

Provided to a base 350 is a receiving portion 352 formed integrally with the base 350 and covering a part of an exterior surface of a capacitor assembly 320. The receiving portion 352 and the surface on the base 350 side and the lower surface of the capacitor assembly 320 are fixed to each other by potting processing using a resinous adhesive 321.

Screws 360 are used for fixing the substrate 310 onto the base 350. However, unlike Embodiment 1, the capacitor assembly 320 is not screwed together with the substrate 310 and the base 350.

The base 350 is fixed to the first housing 24 by screws 370, thereby fixing an inverter assembly 300 to the electric compressor. Although the screws 370 are not shown in the figures in Embodiments 1 and 2, the structure in which the base 350 and the first housing 24 are fixed to each other by the screws 370 is the same as in Embodiments 1 and 2.

In addition, also in Embodiment 3, the screws 370 pass through a cover 390, and the cover 390, the base 350, and the first housing 24 are also screwed together as in Embodiments 1 and 2.

Further, to the base 350, a hermetic terminal 330 and two insulated gate bipolar transistors (IGBT) 340 are fixed. In this case, the fixing of the IGBT 340 is performed by screws 380. The hermetic terminal 330 and the IGBT 340 are electrically connected to the substrate 310 respectively. Further, the hermetic terminal 330 performs the electrical connection between the inverter assembly 300 and an electric motor (not shown) within the first housing 24, while being hermetically isolated between the inverter accommodating chamber 301 and the space where the electric motor 26 is contained.

In the above-mentioned Embodiments 1 to 3, the following modifications may be added thereto.

The structure in which the large components, namely, the capacitor assemblies 120 and 320, the coil 130, and the varistor 140 are fixed to and supported to the base is not limited to the structure described above, and may be appropriately altered as needed.

For example, as in the case of the capacitor assembly 120 (FIG. 5 et al.) of Embodiment 1, the screws 160 and the adhesive 180 may be used in combination to fix the large components firmly. Further, as in the case of the capacitor assembly 320 (FIG. 8) of Embodiment 3, by fixing the large components using only the adhesive without using the screws, the process for forming the screw mounting holes to the large components can be omitted.

The inverter assemblies 100 and 200 used in Embodiments 1 and 2 include the varistor 140 as illustrated in FIGS. 2 and 7. However, an inverter assembly, which does not include the varistor 140 may be used under circumstances where no varistor 140 is required.

What is claimed is:

1. An electric compressor comprising:

a compressor mechanism portion;

an electric motor for driving the compressor mechanism portion;

a housing for accommodating the compressor mechanism portion and the electric motor;

an inverter assembly for converting a direct current into a multi-phase alternate current to supply the converted current to the electric motor and for controlling a rotational frequency of the electric motor;

an inverter accommodating chamber, which is provided by recessing a part of the housing, for accommodating the inverter assembly, characterized in that:

the inverter assembly includes: a substrate having an electric circuit including a switching element; a plurality of components including at least one of a capacitor and a coil; and a base supporting the substrate and the plurality of components, wherein the base includes a receiving portion that covers at least a part of an exterior surface of at least one of the components, and the inverter assembly is detachably fixed inside the inverter accommodating chamber of the housing by detachably fixing the base to the housing; and a cover attached to the housing, the cover covers the substrate, wherein.

2. The electric compressor according to claim 1, wherein the inverter assembly includes the capacitor, the coil and a varistor as the components.

3. The electric compressor according to claim 1, wherein the detachable fixing of the inverter assembly and the housing is realized by screw members.

4. The electric compressor according to claim 1, wherein the detachable fixing of the inverter assembly and the housing is realized by only screw members.

5. The electric compressor according to claim 1, wherein said at least one of the components is fixed to the base by adhesive.

6. The electric compressor according to claim 1, wherein at least one of the components is fixed to the receiving portion by adhesive.

7. The electric compressor according to claim 1, wherein, when the electric compressor is operable, a clearance is formed in a direction of gravity side of an exterior surface of the receiving portion.

8. The electric compressor according to claim 1, wherein, when the electric compressor is operable, an exterior surface in a direction of gravity side of the receiving portion is spaced apart from a part of the housing which is opposed to the exterior surface.

9. The electric compressor according to claim 1, wherein, when the electric compressor is operable, a clearance is formed in a direction of gravity side of an exterior surface of at least one of the components.

10. The electric compressor according to claim 1, wherein, when the electric compressor is operable, an exterior surface in a direction of gravity side of at least one of the components is spaced apart from a part of the housing which is opposed to the exterior surface.

11. The electric compressor according to claim 1, wherein at least one of the components includes a plurality of capacitors, and the plurality of capacitors are integrated.

12. The electric compressor according to claim 11, wherein the integrated plurality of capacitors is received in a container, which is resin molded.

13. The electric compressor according to claim 11, wherein the component including the integrated plurality of capacitors has a mounting portion supported by the base.

14. The electric compressor according to claim 11, wherein the component including the integrated plurality of capacitors is fixed to the base by adhesive.

15. The electric compressor according to claim 11, wherein each of the integrated plurality of capacitors has terminals which are electrically connected to the electric circuit on the substrate, the electric circuit on the substrate has connecting portions to which the terminals are electrically connected, the substrate has slits formed therein from an end of the substrate to the connecting portions so that the terminals are inserted from the end of the substrate to the connecting portions through the slits.

16. The electric compressor according to claim 15, wherein the slits become continuously narrower from the end toward the connecting portions.

* * * * *